US011273345B1

(12) United States Patent
Mumford

(10) Patent No.: US 11,273,345 B1
(45) Date of Patent: Mar. 15, 2022

(54) ADJUSTABLE KNEE ASCENDER CLIMBING APPARATUS

(71) Applicant: Richard Dean Mumford, Acworth, GA (US)

(72) Inventor: Richard Dean Mumford, Acworth, GA (US)

(73) Assignee: Climbing Innovation LLC, Acworth, GA (US)

( * ) Notice: Subject to any disclaimer, the term of this patent is extended or adjusted under 35 U.S.C. 154(b) by 358 days.

(21) Appl. No.: 15/954,578

(22) Filed: Apr. 16, 2018

Related U.S. Application Data

(60) Provisional application No. 62/485,548, filed on Apr. 14, 2017.

(51) Int. Cl.
*A63B 27/00* (2006.01)

(52) U.S. Cl.
CPC ..... *A63B 27/00* (2013.01)

(58) Field of Classification Search
CPC ..... A63B 27/00; A63B 27/02; A63B 2225/09; A62B 35/00; A62B 29/00; A62B 29/02; A62B 29/08
See application file for complete search history.

(56) References Cited

U.S. PATENT DOCUMENTS 3,814,210 A * 6/1974 Hoffman ..... A62B 1/14 182/6
4,667,772 A * 5/1987 Kammerer ..... A62B 35/04 182/6
5,400,869 A * 3/1995 Rocourt ..... A62B 1/14 182/133
7,980,524 B2 * 7/2011 Parker ..... A62B 35/04 248/317
9,643,054 B2 * 5/2017 Frankhauser ..... A63B 27/02
10,052,521 B1 * 8/2018 Mumford ..... A63B 27/02
2002/0104711 A1 * 8/2002 Nichols ..... A62B 1/16 182/192
2010/0181142 A1 * 7/2010 Gerner ..... A62B 35/0081 182/5
2011/0309617 A1 * 12/2011 Eley ..... B65H 69/04 289/1.5
2012/0118666 A1 * 5/2012 Raoul Bingham .... A63B 29/02 182/5

(Continued)

FOREIGN PATENT DOCUMENTS

DE 10011753 A1 * 9/2001 ..... A63B 29/02
FR 2846887 A1 * 5/2004 ..... A63B 29/02

(Continued)

*Primary Examiner* — Colleen M Chavchavadze
*Assistant Examiner* — Candace L Bradford
(74) *Attorney, Agent, or Firm* — Nova IP Solutions LLC

(57) ABSTRACT

A self-advancing knee ascender comprising:
a piece of webbing having a first end and a second end, thereby defining a length;
an adjusting mechanism arranged at a location on the webbing length;
a webbing loop arranged at the second end of said webbing;
a first linking mechanism removably attached to the webbing loop;
a mechanical ascender attached to the first end of the webbing;
a cord having a first end and a second end, constructed to have elastic properties, wherein the second end of the cord is attached to the mechanical ascender; and
a second linking mechanism movably attached at a point along the cord.

16 Claims, 2 Drawing Sheets

(56) References Cited

U.S. PATENT DOCUMENTS

| | | | | |
|---|---|---|---|---|
| 2013/0133981 | A1* | 5/2013 | Spraggon | A63B 27/00 182/134 |
| 2016/0059080 | A1* | 3/2016 | Frankhauser | A63B 29/02 182/134 |
| 2016/0121170 | A1* | 5/2016 | Perner | A62B 35/0068 182/9 |
| 2018/0311518 | A1* | 11/2018 | Cooper | A62B 35/0075 |
| 2020/0376342 | A1* | 12/2020 | Mumford | A63B 27/02 |

FOREIGN PATENT DOCUMENTS

| | | | | |
|---|---|---|---|---|
| WO | WO-2012022943 | A1 * | 2/2012 | A63B 27/00 |
| WO | WO-2014182721 | A1 * | 11/2014 | A63B 29/02 |

* cited by examiner

ADJUSTABLE KNEE ASCENDER CLIMBING APPARATUS

CROSS-REFERENCE TO RELATED APPLICATION(S)

This patent document claims the benefit of U.S. Provisional Application Ser. No. 62/485,548, filed on Apr. 14, 2017. The entire contents of this commonly owned patent application are expressly incorporated by reference herein.

BACKGROUND OF THE INVENTION

Various types of knee ascenders exist on the market today; these devices are used by arborists and contractors to scale trees and vertical objects quickly, safely, and efficiently. Additionally, hobbyists utilize these devices for recreational purposes. Knee ascenders containing auto-locking members are used to grip a rope during the climbing action, and as such they engage the rope while pressure is applied; then the ascender releases while the ascender is pulled upward by the climber. The knee ascender may be hooked by a fixed member to a loop located at a distance from the ascender to accommodate the climber's foot. The fixed member may be constructed from a web-like material that is of a construction strong enough to support the climber's weight.

However, knee ascenders have certain limitations in that the distance between the knee ascender, and any corresponding foot loop or foot stabilizing member was at a fixed location. Therefore, the distance between the knee and the foot was predetermined; or, at best, the length could be adjusted with tools or swapping out components. In any case, it was not convenient to modify any equipment for its first use, or swapping among users, in the field.

The knee ascender may be drawn upward, while the climber raises the knee associated with the device, by a bungee or similar elastic cord. In this type of device the ascender travels up the rope while the climber lifts his knee.

Additionally, there exists a need for an economical knee ascender with a high degree of bungee travel, such that the apparatus could be connected to the user's chest harness, for example, to have sufficient travel (i.e., bungee stretch) to allow a full range of motion for the climber. Current devices have a limited amount of travel, based upon the limited amount of bungee that would be held taught between the chest and the knee throughout the range of motion, and based upon the limited amount of stretch and elastic recoil inherent in the bungee cord itself.

SUMMARY OF THE INVENTION

The devices and embodiments of this disclosure aim to, among other things, provide an easily adjustable knee ascender apparatus with ample bungee components that allow a wide range of motion of the legs of the user. The result is a knee ascender that is readily adjustable, without tools, in a preferred embodiment; where the knee ascender is economically produced and accommodates a wide range of user heights.

A preferred initial embodiment of this disclosure features a piece of webbing, or other strong material, having a first end and a second end, thereby defining a length. The webbing would have an adjusting mechanism arranged at a location on the webbing length (i.e., at a predetermined location on the webbing), with at least one portion of the webbing arranged to move through the adjusting mechanism to affect the overall webbing length, where actuating or otherwise deploying the adjusting mechanism locks the web member's components at a selectable length.

In order to effectively utilize an adjusting mechanism, the web member may feature two sections of webbing. In a two-part web embodiment, a preferred arrangement would have a first piece attached to a foot loop, wherein the first piece has a free end that extends through the adjusting member; while a second piece is arranged to attach to the knee ascender, and then terminates at the adjusting mechanism. Alternatively, the web member may be designed as a single piece where one end feeds through the adjusting mechanism only to make a loop and return to the adjusting mechanism such that a continuous webbing member may be employed.

Those skilled in the art will be aware of many materials and configurations of textiles which would serve as a webbing or web member, and such materials and configurations are contemplated by this disclosure. Likewise, various adjusting mechanisms could be employed; the only requirement is that they be easily operated in the field, and capable of supporting the weight of the user when actuated.

The initial preferred embodiment would also have a webbing loop arranged at the first end of the webbing, and this loop would have a first linking mechanism removably attached. The opposite end of the web would have a mechanical ascender attached (i.e., the first end of the webbing). A cord having a first end and a second end, constructed of materials having elastic properties; and the second end of the cord is attached to the mechanical ascender. The cord has a second linking mechanism movably attached at a point along the cord; and the second linking mechanism is designed to be able to slide along the cord (or, otherwise be movably located), so that the tension may be adjusted. This type of linking mechanism may simply be formed by encircling the cord with another smaller cord which has the linking mechanism attached to it. If the small cord encircles the larger several times, it will create enough friction when pulled as to remain in place. In order to move the small cord along the larger diameter cord (i.e., to adjust the length) the fingers may be used to grasp the several encircling wraps simultaneously. Grasping in this manner will allow the user to adjust the length; which in turn influences the length of travel available and the tension.

This embodiment's webbing loop and the first linking mechanism are meant for convenience, but any configuration that would allow for a foot loop or foot harness to be attached is contemplated by this disclosure; further, the concept of a detachable foot loop is for convenience of adjustment and replacement, a looping type of design could be fabricated directly into the web member. The linking mechanism allows for various pieces of equipment to be easily attached or replaced as needed. Likewise, the cord could be a bungee cord or a shock cord, or similar material to those skilled in the art. The cord is to be attached to the user, with such linking mechanism; the point of attachment may be the waist belt or the chest harness, or other attachment point on the gear worn by the user.

Another preferred embodiment of this disclosure would be a self-recoiling cord model. This embodiment is similar in design to the previous embodiments, however, here the cord is coiled back into a housing. Similarly, this embodiment includes a piece of webbing having a first end and a second end, thereby defining a length. There is an adjusting mechanism arranged at a location on the webbing length, and a webbing loop is arranged at the second end of the webbing. The webbing loop has a first linking mechanism removably attached thereto.

This recoiling embodiment has a mechanical ascender attached to the first end of the webbing, and the unique mechanical ascender is arranged to accept a retractable cord housing. This housing is arranged to accept the second end of a cord, and to cause the cord to be coiled inside the housing. This coiling function allows more cord to be used, and to be stored in a compact area. With more cord length, there is a larger range of stretch available, and therefore a wider range of motion for the use of the device.

The first end of the cord is arranged to be attached to the chest of the user, for example, with a second linking mechanism. This type of embodiment has an increased length of cord available (i.e., via un-coiling as well as stretching mechanics), which in turn increases the distance that the knee (i.e., and the knee ascender) can move during the climbing motion.

The retractable cord housing should contain at least one spindle, and two spindles have been shown to be most effective in providing a large length of cord to be wound around them. The end of the cord is attached to a spindle itself, or to the interior of the housing. As the cord is pulled or stretched away from the housing the spindles rotate cooperatively, and allow the cord to travel outward. The spindle recoil is based on a spring-like mechanism within or arranged to operate in conjunction with the spindle, which is known to those skilled in the art.

In a preferred multi-spindle embodiment, the retractable cord housing may be arranged to accept the cord internally in a fashion involving wrapping the cord around the spindles in pulley-like arrangement. The cord may make one, two or more complete revolutions (i.e., wraps) around the spindle set.

Single and double spindle designs have been described, but this disclosure contemplates designs containing a single spindle, as well as more than two spindles. Arrangements utilizing more than two spindles may also cause the cord to take on a shaped route within the housing, which may allow a more compact design. Additionally, roller or follower spindles, which serve to align the cord or keep the cord within a preferred coiling profile (e.g., away from the housing, to avoid wear), may be employed.

In yet another preferred embodiment, a retractable cord housing is arranged on a webbing type material or tether as a first section, with another second section of same or similar material located at the end of the cord which is arranged to be pulled from the retractable cord housing. The first section and the second section may have a releasable fastening device located thereon. In this embodiment, the tether may be constructed from an inelastic or strong material, while the cord is manufactured from an elastic material.

In yet another preferred embodiment, a retractable cord housing is arranged with a releasable fastening device located thereon, and a cord that is arranged to be pulled from the retractable cord housing. The retractable cord housing may also have releasable fastening device located thereon. The cord may also have releasable fastening device located on the end, distant to the housing when the cord is stretched or distended therefrom. The cord may be constructed from materials with a wide variety of elasticity, which may provide increasing tension as the cord is withdrawn from the housing (along with tension provided by the one or more spindles or other recoiling member located therein).

In these embodiments utilizing a retractable cord housing, the cord component may be releasably locked or secured with respect to the housing, such that the cord provides positive tension where no additional cord may be withdrawn from the housing. In this type of embodiment, a simple one-way travel stop may be employed (e.g., a stopping mechanism similar to that seen on a knee ascender type of component). This travel stop may be able to be rotated or secured such that it only engages as needed or as preferred.

DETAILED DESCRIPTION OF THE INVENTION EMBODIMENTS

Figure 1:
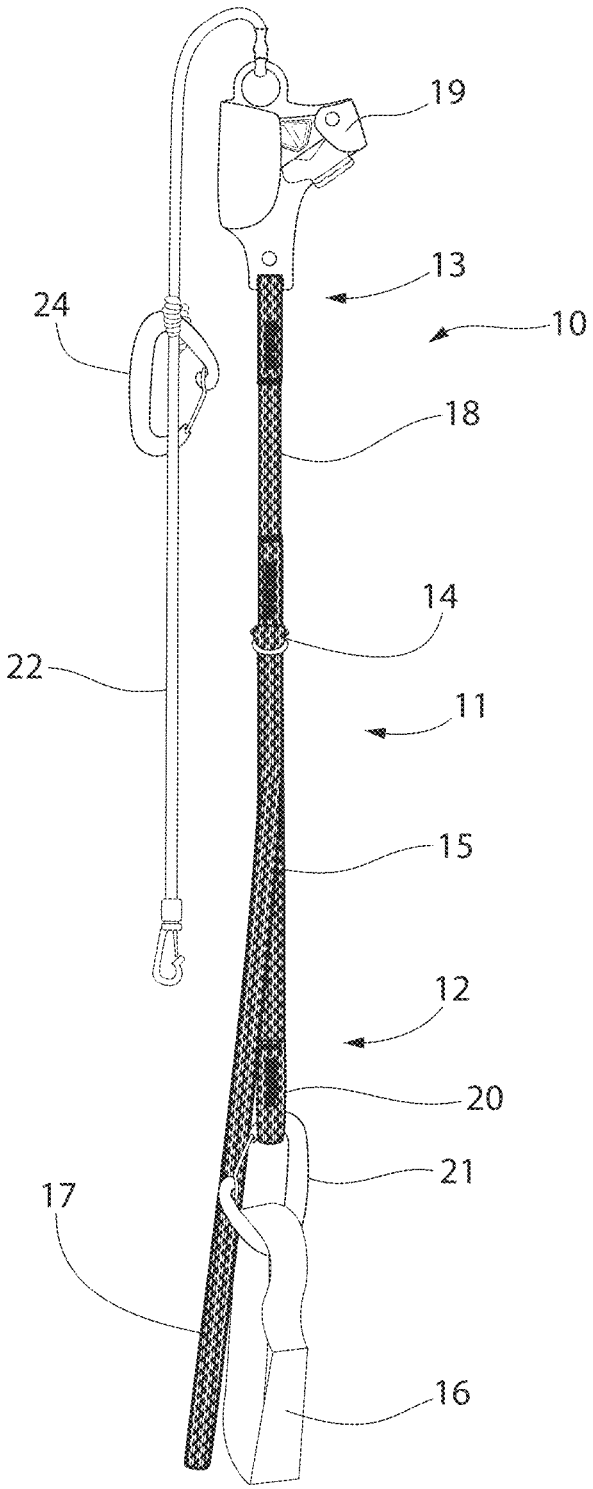
FIG. 1 is a front view of an example embodiment of the present disclosure.

Reference is made to FIG. 1 for the illustration of one preferred embodiment of a knee ascender made according to the present invention, which is designated generally by the reference numeral 10. This preferred initial embodiment of knee ascender 10 features a piece of webbing 11, or other strong material, having a first end 12 and a second end 13, thereby defining a length. The webbing 11 would in a preferred embodiment have an adjusting mechanism 14 arranged at a location on the webbing length (i.e., at a predetermined location on or along the webbing 11), with at least one portion of the webbing arranged to move through the adjusting mechanism 14 to lock the web member's components at a selectable length. The overall position of the adjusting mechanism 14 along the length of webbing 11 is not critical to the operation, as will be appreciated by this skilled in the art.

In order to effectively utilize an adjusting mechanism, the web member may feature two sections of webbing. In a two-part web embodiment, a preferred arrangement would have a first web section 15 attached to a foot loop 16, wherein the first web section 15 has a free end 17 that extends through the adjusting mechanism 14; while a second web section 18 is arranged to attach to a knee ascender 19, and terminates at the adjusting mechanism. Alternatively, the web member may be designed as a single piece (not shown) where one end feeds through the adjusting mechanism 14 only to make a loop and return to the adjusting mechanism 14 such that a continuous webbing member may be employed.

These preferred embodiments may also have a webbing loop 20 arranged at the first end 12 of the webbing, and this loop may have a first linking mechanism 21 removably attached. A cord 22 is attached to the mechanical knee ascender 19. The cord 22 has a second linking mechanism 24 movably attached at a point along the cord; and the second linking mechanism 24 is designed to be able to slide along the cord, so that the tension supplied by cord 22 may be adjusted.

Figure 2:
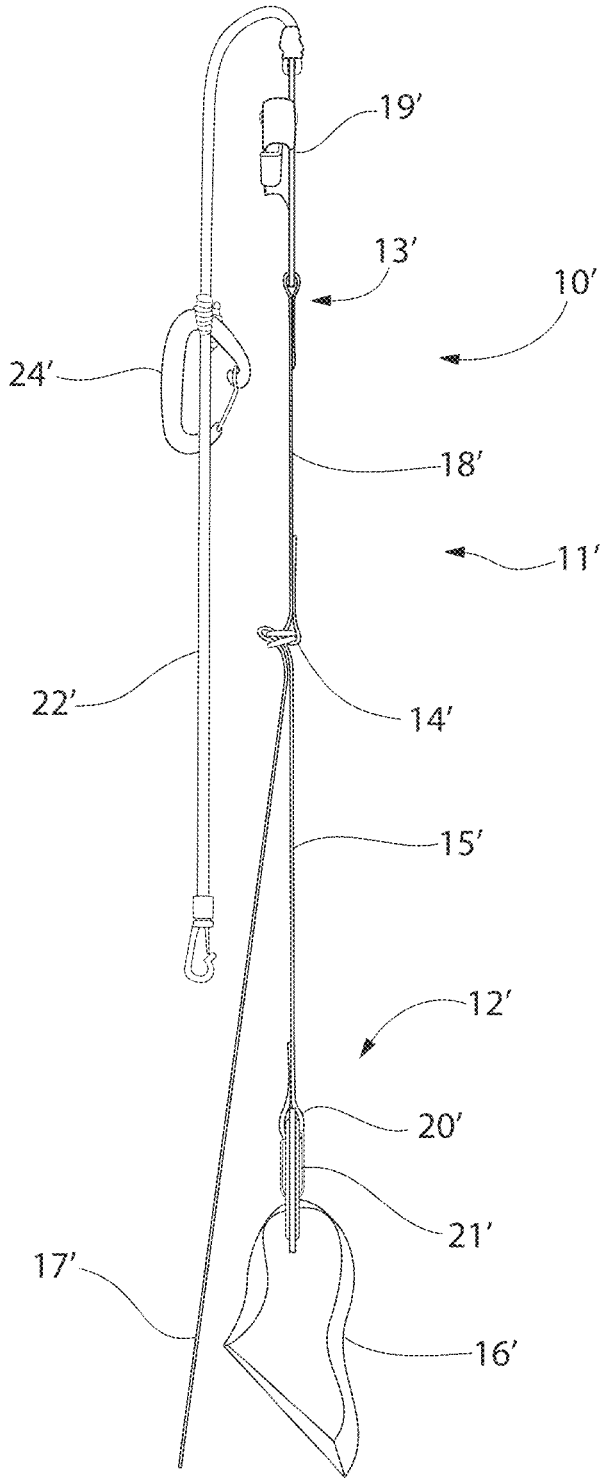
FIG. 2 is a side view of the embodiment disclosed in FIG. 1.

Reference is now made to another preferred embodiment of the present invention, which is illustrated at FIG. 2. The same structures, components and features existing in this embodiment; that have been introduced in previous figures or embodiments will be represented by the same reference numeral with, however, the addition of a prime marking. In instances where this scheme may cause confusion, for example, a component in a similar location, but serving a different function, such component may be assigned a new numeric designation.

The FIG. 2 illustration serves to demonstrate a side view of knee ascender 10' (see reference number 10, at FIG. 1, for example). This view indicates preferred web member 11' arrangement relative to, or as coordinated with the adjusting mechanism 14'. Further, the travel of the first web section 15' through the adjusting mechanism 14' such that a free end 17' is formed, can be seen. Additionally, the termination of the second web section 18' can be seen to occur at the adjusting mechanism 14'. While the second web section 18' is shown terminating at the adjusting mechanism 14', the orientation of the terminating member may be alternately placed; that is, the design of the first web section 15' may be switched with the design of the second web section 18', and vice-versa.

The coordination of the first web section 15' with the first linking mechanism 21' and the foot loop 16' can also be seen in this view. The webbing loop 20' design is not meant to be limiting, as those skilled in the art can appreciate the various methods in which the first linking mechanism 21' may be attached to the first web section 15'.

While this disclosure refers to general illustrative embodiments as well as various particular embodiments, it should be understood that the disclosure is not limited thereto. Modifications can be made to the embodiments described herein without departing from the spirit and scope of the present disclosure, even where certain modifications are suggested, the list or set of proposed modifications is not necessarily exhaustive. Those skilled in the art with access to this disclosure will recognize additional modifications, embodiments, and methods of use within the scope of this disclosure; and similarly, additional fields of use in which the disclosed invention could be applied are contemplated. Therefore, this detailed description is meant to be enabling but not meant to be limiting. Further, it is understood that the apparatus and methods described herein can be implemented in many different embodiments of hardware, devices, or systems. Any actual apparatus, method of manufacture, or method of use, described is likewise not meant to be limiting. The operation and behavior of the apparatus and methods presented are described with the understanding that modifications and variations of the embodiments as well as modalities of use and operation are possible; with each modification potentially influencing the operation or outcome.

What is claimed is:

1. A self-advancing knee ascender comprising:

a piece of webbing having a first end and a second end, thereby defining a length, an adjusting mechanism arranged at a location on the webbing length, a webbing loop arranged at said second end of said webbing, and a first linking mechanism removably attached to said webbing loop;

a mechanical ascender having an upper portion and a lower portion, having said first end of said webbing attached to the lower portion of said mechanical ascender; and an elastic cord having a first end and a second end, wherein said second end of said cord is attached to the upper portion of said mechanical ascender such that the second end of said cord and the first end of said webbing do not overlap on said mechanical ascender and a second linking mechanism movably attached at a point along said cord.

2. The self-advancing knee ascender of claim 1, wherein said adjusting mechanism serves to allow adjustment of the length of said webbing.

3. The self-advancing knee ascender of claim 1, wherein said first linking mechanism is arranged to releasably receive an apparatus.

4. The self-advancing knee ascender of claim 3, wherein said apparatus comprises at least one of a foot harness or a foot loop.

5. The self-advancing knee ascender of claim 1, wherein said cord comprises at least one of a bungee cord or a shock cord.

6. The self-advancing knee ascender of claim 1, wherein said cord is releasably attached to an opening on the upper portion of the mechanical ascender.

7. The self-advancing knee ascender of claim 1, wherein said first end of said webbing is attached to an opening on the lower portion of said mechanical ascender.

8. A self-advancing knee ascender comprising:

a piece of webbing having a first end and a second end, thereby defining a web member;

a mechanical ascender having an upper portion and a lower portion, having said first end of said webbing attached to the lower portion of said mechanical ascender; and;

an elastic cord having a first cord end and a second cord end, wherein said second end of said cord is releasably attached to said mechanical ascender and a second linking mechanism releasably attached to said cord at a location between said first cord end said second cord end; and wherein said cord comprises at least one of a bungee cord or a shock cord and the second end of said cord and the first end of said webbing do not overlap on said mechanical ascender.

9. The self-advancing knee ascender of claim 8, further comprising an adjusting mechanism arranged at a location on the web member that is configured to adjust the length of said web member.

10. The self-advancing knee ascender of claim 8, further comprising a first linking mechanism removably attached to the second end of the web member that is configured to receive at least one of a foot harness or a foot loop.

11. The self-advancing knee ascender of claim 8, further comprising a webbing loop arranged at said second end of said webbing.

12. The self-advancing knee ascender of claim 8, wherein the upper portion of said mechanical ascender further comprising an opening and the second end of the cord is releasably attached to the mechanical ascender through said opening.

13. A self-advancing knee ascender comprising:

a piece of webbing having a first end and a second end, thereby defining a length, an adjusting mechanism arranged at a location on the webbing length, a first linking mechanism removably attached to said second end of said webbing, and a foot loop arranged to be attached to said first linking mechanism;

a mechanical ascender having an upper portion and a lower portion, having said first end of said webbing attached to the lower portion of said mechanical ascender; and an elastic cord having a first end and a second end, wherein said second end of said cord is attached to the upper portion of said mechanical ascender and a second linking mechanism movably attached at a point along said cord.

14. The self-advancing knee ascender of claim 13, wherein said cord comprises at least one of a bungee cord or a shock cord and the second end of said cord and the first end of said webbing do not overlap on said mechanical ascender.

15. The self-advancing knee ascender of claim 13, wherein said cord is arranged to be attached to the chest of the climber.

16. The self-advancing knee ascender of claim 13, wherein the adjusting mechanism is arranged at a location on the webbing that is configured to adjust the length of said webbing.

* * * * *